US006957556B1

(12) United States Patent
Ha

(10) Patent No.: US 6,957,556 B1
(45) Date of Patent: Oct. 25, 2005

(54) DISK TUMBLER LOCK AND KEY, IMPROVED MEANS AND METHODS OF MANUFACTURING FOR

(76) Inventor: Don Dongcho Ha, 404 E. First St., #607, Long Beach, CA (US) 90802

( * ) Notice: Subject to any disclaimer, the term of this patent is extended or adjusted under 35 U.S.C. 154(b) by 73 days.

(21) Appl. No.: 10/881,899

(22) Filed: Jun. 30, 2004

(51) Int. Cl.[7] ..... E05B 27/08
(52) U.S. Cl. ..... 70/491; 70/403; 70/408; 70/409
(58) Field of Search ..... 70/491, 496, 407–409, 70/403, 404, 411; 42/70.04, 70.05, 70.06, 42/70.11

(56) References Cited

U.S. PATENT DOCUMENTS

| | | | | | |
|---|---|---|---|---|---|
| 1,141,215 | A | * | 6/1915 | Sohm | 70/491 |
| 2,706,394 | A | * | 4/1955 | Wohrle | 70/491 |
| 2,993,361 | A | * | 7/1961 | Van Lahr | 70/491 |
| 3,102,412 | A | * | 9/1963 | Christopher | 70/491 |
| 3,142,167 | A | * | 7/1964 | Christopher | 70/411 |
| 3,234,765 | A | * | 2/1966 | Kerr | 70/208 |
| 3,320,783 | A | * | 5/1967 | Kerr | 70/401 |
| 3,339,384 | A | * | 9/1967 | Greenwald | 70/491 |
| 3,411,331 | A | * | 11/1968 | Schlage | 70/461 |
| 3,524,335 | A | * | 8/1970 | George | 70/491 |
| 3,681,957 | A | * | 8/1972 | Sturgeon | 70/411 |
| 4,069,696 | A | * | 1/1978 | Steinbach | 70/491 |
| 4,622,834 | A | * | 11/1986 | Hughes | 70/395 |
| 4,735,069 | A | * | 4/1988 | Steinbach | 70/491 |
| 4,967,578 | A | * | 11/1990 | Sheu et al. | 70/491 |
| 6,058,750 | A | * | 5/2000 | Li | 70/358 |
| 2004/0231379 | A1 | * | 11/2004 | Yu | 70/491 |

FOREIGN PATENT DOCUMENTS

| | | | | |
|---|---|---|---|---|
| FR | 0353555 | * | 9/1905 | 70/491 |
| FR | 2450928 | * | 11/1980 | 70/403 |
| IT | 0415509 | * | 10/1946 | 70/491 |

* cited by examiner

*Primary Examiner*—Lloyd A. Gall

(57) ABSTRACT

An improved disk-tumbler lock and key for use with a gun-lock device includes a key specifically adapted to be ring-mounted so that it may be worn by and is thus available for the user at all times. The particular shape of the key includes those characteristics which would be desirable for such a key which will function as a ring for the most part, including a sufficient strength to endure physical abuse resulting from common use as a ring, attractive appearance so that the user would be willing to wear it for extended periods, and an inconspicuous jewelry-like appearance to avoid unwarranted attention. In addition, the particular shape of the key and the mating keyway in the lock assembly are aimed at further improving the speed and reliability at which the key may be inserted into the lock assembly aided only by the user's tactile senses. The physical shape also lends itself to be easily and inexpensively manufactured using various fabrication processes.

24 Claims, 5 Drawing Sheets

DISK TUMBLER LOCK AND KEY, IMPROVED MEANS AND METHODS OF MANUFACTURING FOR

BACKGROUND OF THE INVENTION

1. Technical Field

This invention relates to improvements in a key and a lock device of an axial-pin disk-tumbler type, especially those configured in combination with a handgun lock device such as disclosed in the co-pending U.S. patent application Ser. No. 10/820,987 of Ha. More particularly the invention relates to improvements in the key and the means for receiving the key within the lock device and the manufacturing methods thereof.

2. Description of the Related Art

A particular gunlock device disclosed and claimed by the co-pending U.S. Patent application of Ha listed in the Cross Reference to Related Applications section and referred to hereunder as prior art is specifically configured for use on a loaded and attended firearm. For example, a duty handgun of a law enforcement officer may be maintained in a loaded condition and kept in the holster, but protected with the gun-lock device to alleviate the possibility of it being intercepted by a criminal during an arrest and have it used against the officer. Also, a law-abiding citizen may keep his handgun loaded and at easy reach within his premises for defense use against impending danger, but have the gun protected with the gun-lock device to prevent from an accidental discharge resulting from mishandling by any of his family members. For these and many other scenerios where the firearm is attended, the most important characteristic for the gun-lock device should be that it lend itself to be quickly and reliably unlocked by the authorized user in those times of need without requiring a great deal of mental coordination (to remember where the key is or what the combination number is) or manual dexterity from the user to negotiate the unlocking operation. Since the firearm will be maintained within a close proximity and under cognizance of the owner at all times, the level of security required of the lock device, for example the strength of the lock casing or the lock mechanism's resistance to being picked, would rank distant second.

The co-pending U.S. Patent application of Ha elaborates on many advantages of a key operated gun-lock device of an axial-pin, disk-tumbler type over those of other types and discloses and claims such a gun-lock device in combination with a special ring-mounted key. Such key may be worn by the user and, thus at any time, made immediately available for the user to unlock the lock device. To satisfactorily serve dual role as both the key and a ring, the ring-mounted key must meet several objectives beyond that primary functional objective of unlocking the lock device. First, the ring-mounted key must be visually attractive for the user to be willing to wear it for extended periods. Second, key portion should be sufficiently strong to endure common use as a ring and survive without damage any reasonable magnitude of physical abuse exerted thereupon. Third, the overall shape of the key should be reasonably inconspicuous to the eyes of the others so as not to draw unwarranted attention to it when it is plainly worn by the user. Fourth, and foremost as a key used in combination with a gun-lock device, the key and the receiving lock assembly should allow for a speedy and reliable insertion of the key into the lock assembly using only of the user's tactile senses and without a high degree of manual dexterity. Fifth, the physical design of the key must lend itself to be manufactured easily and inexpensively using conventional fabrication methods available in the industry.

A particular key design presented by the co-pending U.S. Patent application of Ha comprises a set of finger-like cylindrical projections symmetrically disposed about a conical pillar centrally placed on the key body. The finger-like projections are slender pins which are individually press-fitted into the mating holes prepared into the key body and are subsequently trimmed to predetermined individual heights as required for proper cooperation with the lock assembly. The operation of an axial-pin disk-tumbler type lock device with regard to how the key interacts with the tumbler pins within the lock to unlock the device is well known in the art and will be discussed further in the foregoing section, Detailed Description of the Invention.

A key so constructed as described above and hereinafter referred to as "prior art key of Ha" is shown in FIG. 13 and FIG. 14 of the drawings. In consideration with regard to the five objectives for a ring-mounted key discussed above, the prior art key of Ha is visually attractive. Also, during the key-insertion into the lock, the centrally placed conical pillar would quickly find its way into the mating recess at the receiving face of the lock assembly, and thus, the key would self-guide and allow speedy and reliable engagement with the lock. The prior art key of Ha therefore satisfies two of the five objectives. However, because the individual fingers have slender proportions and are supported only at the base, they are insufficiently guarded against normal physical abuse inflicted thereupon resulting from common use as a ring. Additionally, these individually standing fingers cast an extraordinary appearance inconsistent with modern jewelry designs, and thus would elevate conspicuity. Lastly, the prior art key would be relatively difficult and costly to manufacture. The manufacturing procedure would involve, first, precision machining operation to prepare correctly sized and positioned holes in the key body to receive the individual pins, then, a great deal of skill and care would be required during the manual press-fit operation to ensure that these pins are installed straight and not bent nor buckled. If these pins are not correctly installed the key would not be received into the mating keyway on the face of the lock assembly.

During the search for a key design better suited for a ring-mounted application, a traditional, hollow cylindrical key used with commercially available conventional disk-tumbler type lock was considered. This key design typically includes a set of semi-circular or semi-rectangular recesses machined along the outer circumference of the hollow cylindrical body and are controlled to predetermined individual depths along the longitudinal axis of the key body for proper cooperation with the tumbler pins within the mating lock assembly. A key of this type is well known by the general public and are shown and sufficiently described in detail in such prior art Patents of Hughes, Kerr, and Christopher, herein listed as the References Cited. In consideration with regard to the five objectives for a ring-mounted key discussed above, first, the traditional hollow cylindrical key is not aesthetically pleasing. However, second, its one-piece cylindrical construction is durable and should not easily incur damaged from normal physical abuse resulting from common use as a ring. Third, because the key design of this type is so well known by the general public, it will immediately be recognized as a key of sort and generate unwarranted attention. Fourth, the physical designs of the hollow cylindrical key and the mating conventional disk-tumbler lock do not incorporate any specific guiding features aimed at facilitating the key-to-lock alignment during the key insertion process. In fact, it is well known from experience, a close sight and manual coordination is required during the operation of a lock and key of this type in order to correctly align and insert the key into the lock assembly. Fifth, the hollow cylindrical key may be easily and inexpensively manufactured. Thus, the traditional hollow cylindrical key design of the conventional disk tumbler lock device meets two of the five above discussed objectives for a ring-mounted key. However, it fails to satisfy the most important criteria for a key used in combination with such gun-lock device as mentioned, as it does not lend itself to a speedy and tactile-only key-to-lock engagement operation.

BRIEF SUMMARY OF THE INVENTION

The present invention addresses the concerns outlined above and presents a better key design in combination with an axial-pin disk-tumbler lock device. The key design of the invention utilizes a similar key body geometry of the prior art key of Ha, except, instead of the individually-standing plurality of pins and a conical pillar therein, the invention utilizes a one-piece key portion coaxially placed on the face of the body portion. The key portion is defined as having a center pillar part with a convex feature at its free end joining a plurality of radial-outwardly projecting blade parts, thus forming a star or an asterisk shaped cross section. The one piece key portion is prepared at one end to be press-fitted into a receiving hole machined in the key body and the opposite end prepared by having the ends of the blade portions individually trimmed to predetermined heights above the body to properly cooperate with the tumbler pins within the lock assembly. The receiving face of the lock assembly has a similar star shaped keyway opening so arranged for the key portion to be inserted therein allowing access to and to cooperate with the tumbler pins. The receiving face also incorporates a concave feature coaxially placed thereon and so designed to cooperate with the convex feature at the tip of the center pillar part of the key portion to axially align the key with the lock assembly during the key insertion process. This is aimed at improving the speed and reliability at which the key engages with the lock assembly by use only of the user's tactile senses as earlier mentioned.

In consideration with regard to the five above described objectives for the ring-mounted key design, the one-piece design of the key portion of the present invention affords a greatly improved strength over the design which is based on the individually supported pins and center pillar of the prior art key of Ha. Further, the star-shape cross section of the key of the invention lends itself aesthetically pleasing and is jewelry-like in design, thus the key would likely be accepted by casual observers as an ordinary jewelry piece and not as a key, while the owner would likely be more willing to wear it as a ring for extended periods. Also, as described, the center pillar part of the key portion with a convex tip in combination with the mating concave feature on the face of the lock assembly provide a means for greatly improving the speed and reliability of the key-to-lock engagement. Further the one-piece key portion of the invention lends itself to be inexpensively and easily manufactured without requiring a great deal of precision machining nor skilled manual assembly operations.

There are several fabrication methods available for manufacturing the key of the invention. The one-piece key portion may be fabricated from a metal blank section extruded into the star shape cross section. The blank section may be machined at one end in preparation for press-fit into a receiving hole in the key body, the blade parts at the opposite end trimmed to correct individual heights, and on the same opposite end the central pillar part prepared with correct diametral and convex features. The key may also be made by fabricating the entire key member in one-piece from a casting already incorporating the features of the body and the key portions. The key member may then be completed by final machining the casting, which would involve only of trimming the blade parts to their respective functional heights as most of the physical features of the key member would already be incorporated into the casting. Using the casting method the ring member may also be incorporated into the casting to form a one-piece integrated key and ring unit or the ring member may be made into a separate individual piece which may subsequently be mechanically joined with the key member. It is apparent that the key member may also be fabricated from a one-piece billet material by using automated milling and turning operations, fabricated from a thermoplastic material using an injection molding process, or from any suitable material using any one or combination of these and other fabrication processes known and utilized in the art.

As briefly described above, the key and the lock device of the present invention provides many improvements and benefits over the prior art. The one-piece design of the key portion produces a durable and inexpensively manufacturable key member. In combination with a concave feature on the face of the lock assembly and with a convex feature on the key member, the key and lock are self-aligning with each other and thus provide a means for quick and reliable key-to-lock engagement. Aesthetically pleasing and jewelry-like appearance of the key will allow the user to inconspicuously wear it as a ring at all times without raising unwarranted attention by the others and, thus, have the key at ready for immediately use at all times. The following illustrative drawings and detailed description make the foregoing and other objects, features, and advantages of the invention more apparent.

DETAILED DESCRIPTION OF THE INVENTION

FIGS. 1–10 and 12 of the drawings illustrate various aspects of a key assembly 10 and axial-pin disk tumbler lock assembly 20 constructed according to the invention. Although the foregoing may describe the key and the lock assembly specifically in combination with a gunlock device, the inventive concepts disclosed and claimed are not so restricted. The lock and key combination constructed according to the invention may be configured for use in any key lock applications, including cabinet locks, automotive ignition locks, door locks, padlocks, and many others, so long as speedy key-to-lock engagement and tactile-only operation is desirable in the application.

Figure 1:
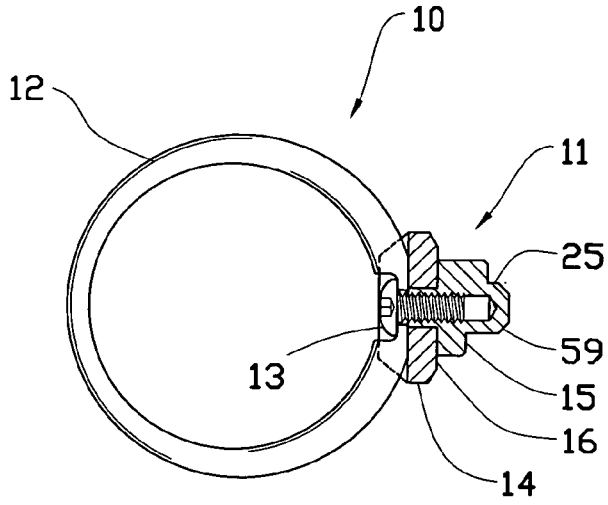
FIG. 1 of the drawing is a partial cross section showing the ring-mounted key assembly constructed according to the invention.
Figure 2:
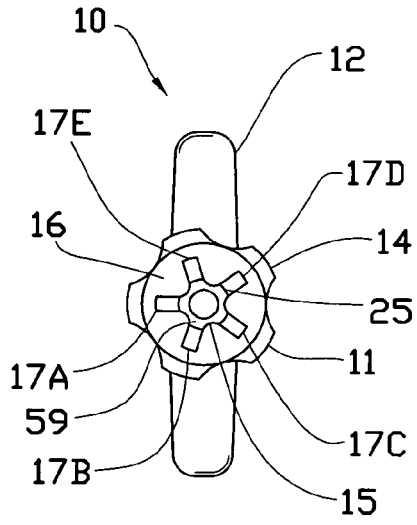
FIG. 2 is a frontal view of the ring-mounted key assembly.

The ring-mounted key assembly 10 of FIG. 1 includes a ring member 12, suitably constructed to be worn on a user's finger and specifically adapted to allow the key member 11 to be mounted thereon using a screw fastener 13. On the body portion 14 of the key member 11 is a flat face 16 which is designed to abut front face 21 of the lock assembly 20 when the key is fully inserted into the lock. The key portion 15 of the key member is constructed from a one-piece blank 18 of a symmetrical cross-sectional shape made from a section cut from a length of metal blank 19, which may be fabricated by using methods such as metal extrusion or metal casting process, both of which are well known and utilized in the art. The cross-section of the key portion 15 of the invention is a star shape comprising five radial-outwardly projecting blade parts 17(A thru E), where 17A, 17B, 17C, and 17E are shown and 17D is hidden behind the center pillar part 25 in FIG. 6, joined with the center pillar part 25 at the longitudinal center of the key portion. The blade parts are individually trimmed at the lock-facing end to predetermined heights above the flat face 16 as required to correctly cooperate with the lock assembly when the key is inserted into the lock assembly. The center of the key portion is maintained untrimmed and at a fixed height above the blade parts to form a center pillar part 25 earlier described. The end of the center pillar part incorporates a convex tip 59 placed thereon to cooperate with a concave surface 22 on the face of the lock assembly to facilitate axial alignment of the key with respect to the lock assembly during the key insertion, as earlier described.

Figure 3:
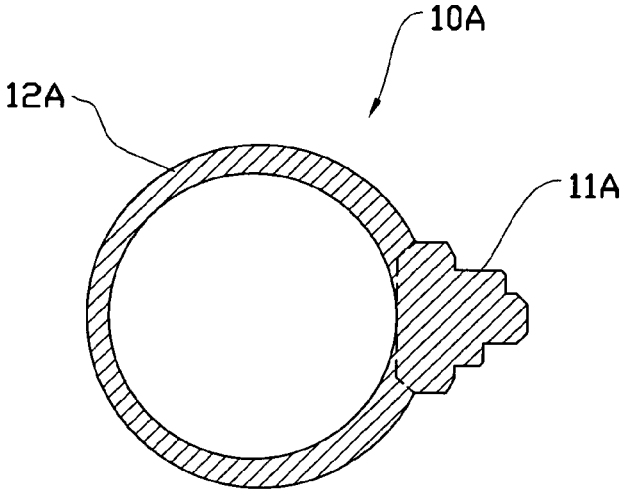
FIG. 3 is a cross section showing a one-piece fabrication of the integrated key and ring unit constructed according to the invention using a metal casting or thermo-plastic injection molding process.
Figure 4:
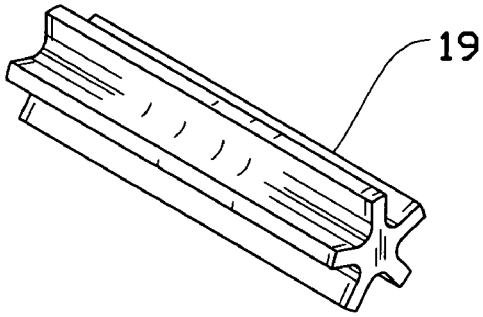
FIG. 4 is an isometric view of an extruded metal blank section of a cross-sectional shape according to the invention.
Figure 5:
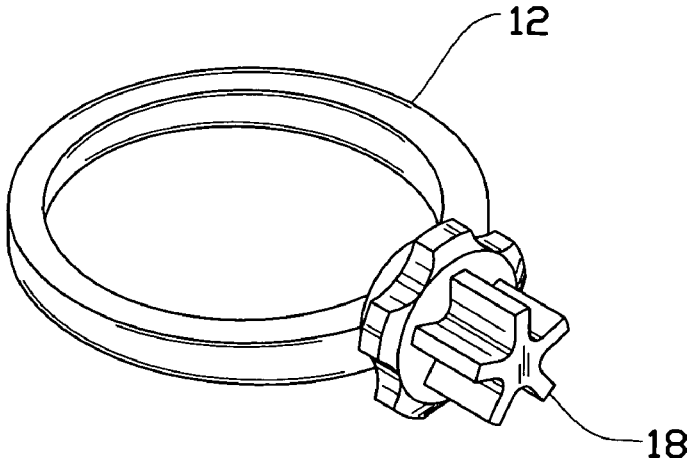
FIG. 5 is an isometric view of the ring-mounted key assembly at prior-to-finish stage with a blank key portion.
Figure 6:
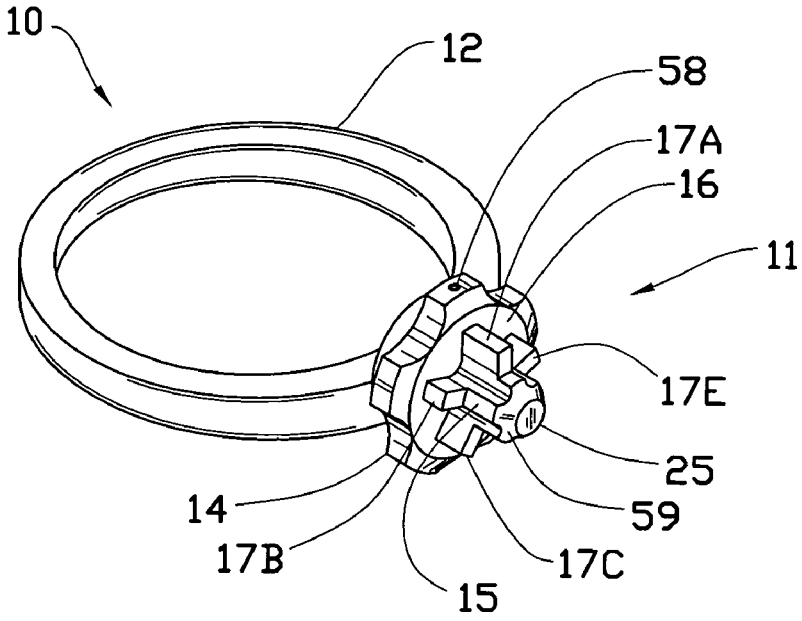
FIG. 6 is an isometric view of the ring-mounted key assembly at finished stage.
Figure 7:
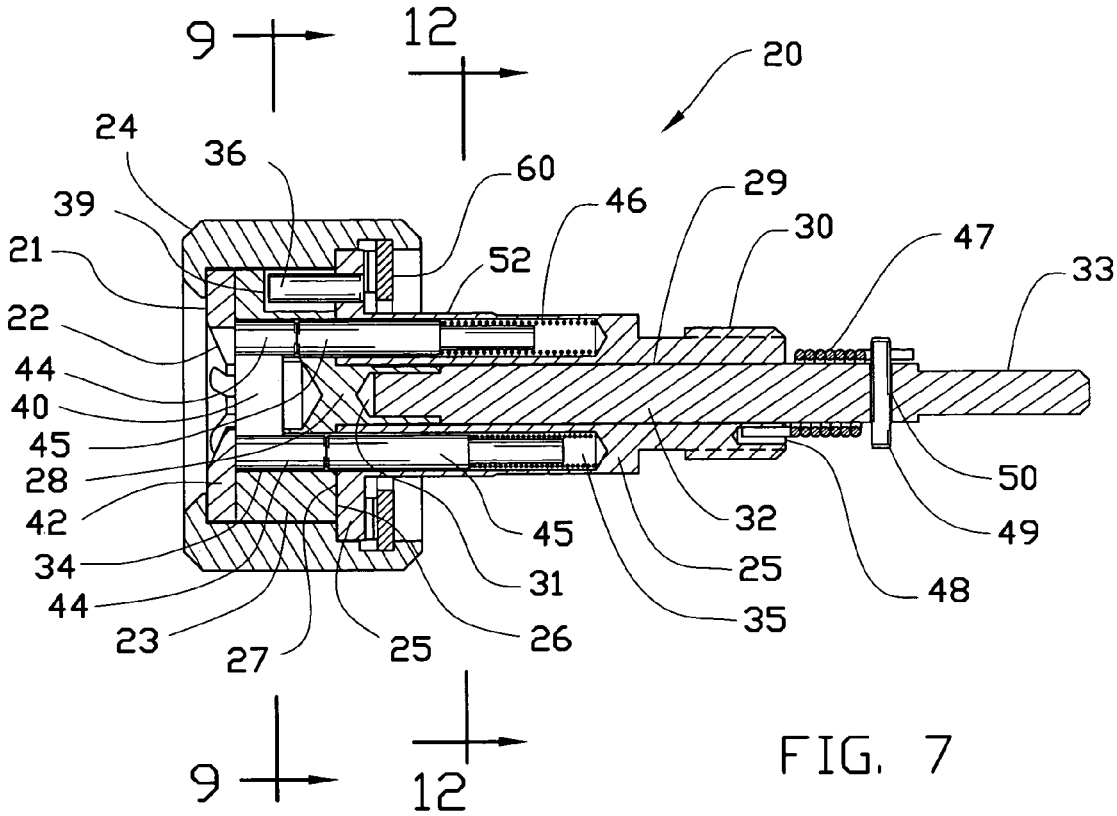
FIG. 7 is an enlarged partial cross section showing the lock assembly constructed according to the invention. For simplicity and clarity, the visible two of the five pairs of tumbler pins 44 and 45 and the associated members and features are shown aligned on the section plane shown.

In addition to the above fabrication procedure where the key member is first made into two machined pieces of a key portion and a body portion which are later mechanically joined, the key member may also be constructed using various metal casting processes. A one-piece metal casting may be created incorporating unfinished blade heights, but otherwise include most of the finished exterior physical dimensions and features of the body and the key portions. The one-piece casting then may undergo final machining operation to trim the blade parts to finished heights. This method has an advantage of also being able to produce the key member portion 11A already integrated with the ring member portion 12A to form a integral key and ring unit 10A as shown in FIG. 3, thus producing a low-cost and one-piece construction alternative. Similarly, the one-piece integral key and ring unit 10A may also be fabricated out of a high-strength thermo-plastic material using an injection molding process.

The lock assembly incorporates a tumbler cylinder 23, which is housed within the outer sleeve 24 and is rotatable about the longitudinal axis of and with respect to the lock body 25. It has a flat distal surface 26 which abuts flat face 27 at the proximal end of the lock body 25, and a shank portion 28 which fits within the bore 29 of the lock body to serve as the rotational support for the tumbler cylinder. On the distal end of the lock body is a threaded portion 30 arranged to provide a structural connection means with the tube member of the gun-lock device of prior art Patent application of Ha. At the free end of the shank portion 28 is a hole 31 for receiving shaft 32 with interference fit. The free-end 33 of the shaft provides a means for completing a mechanical connection with the actuator mechanism of the gun-lock device of prior art Patent application of Ha. It is apparent that the threaded portion 30 and the free-end 33 of the shaft may be modified as necessary to specifically adapted to any other lock applications.

Figure 9:
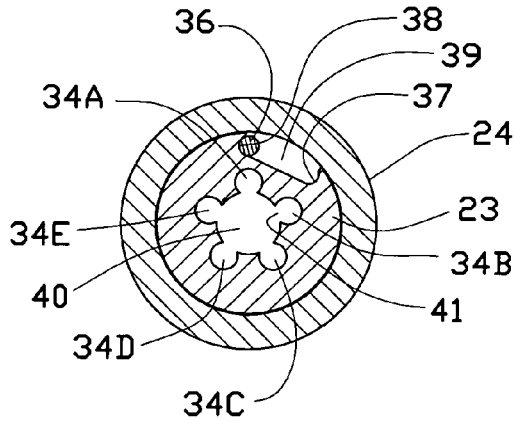
FIG. 9 is a cross section of the lock assembly viewed in the direction and along the section plane 9—9 established in FIG. 7. For simplicity and clarity, only those features incident on the section plane are shown. Any unhidden features fore and aft of the section plane are not shown.
Figure 11:
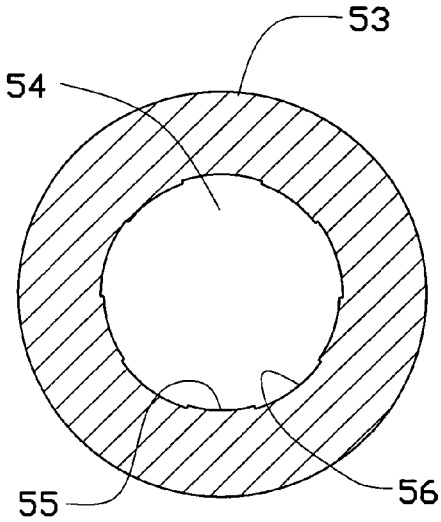
FIG. 11 is a cross section of a barrel of a firearm.
Figure 12:
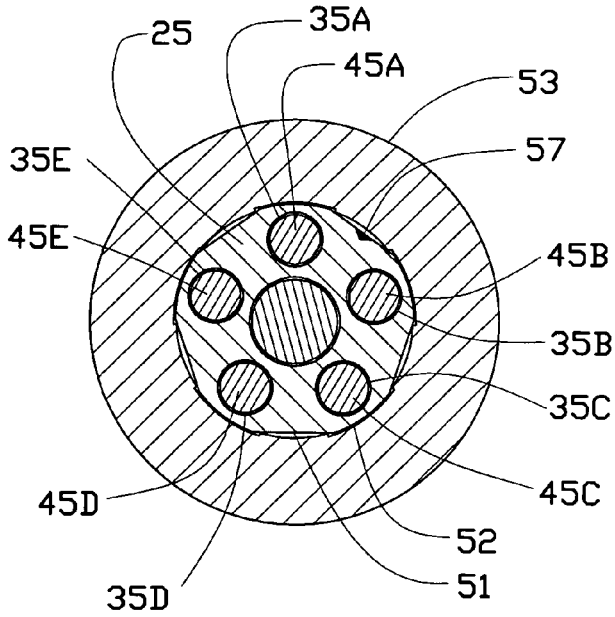
FIG. 12 is an enlarged cross section of the lock assembly viewed in the direction and along the section plane 12—12 established in FIG. 7 and shown inserted within the barrel of FIG. 11.
Figure 13:
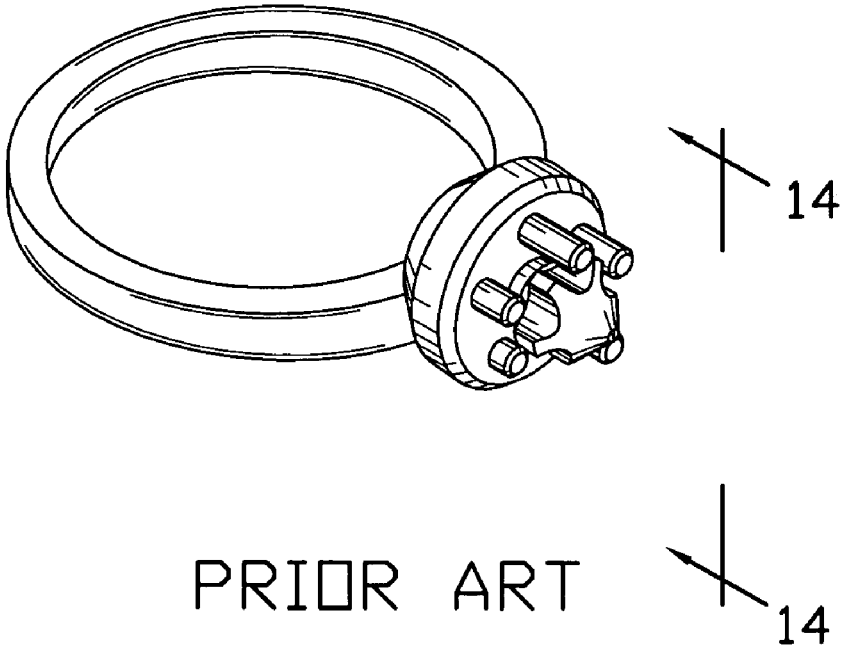
PRIOR ART FIG. 13
FIG. 13 is an isometric view of a ring-mounted key of prior art Patent application of Ha.
Figure 14:
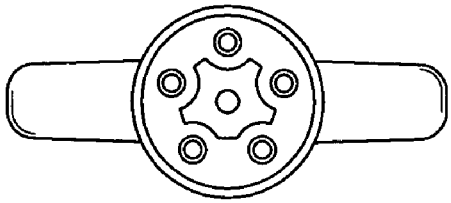
PRIOR ART FIG. 14
FIG. 14 is a frontal view of a ring-mounted key of prior art Patent application of Ha, as viewed in the direction 14—14 established in FIG. 13.

The tumbler cylinder has a plurality of cylindrical recesses 34(A thru E), which are best shown in FIG. 9, extending thru the entire length of the part and are arranged parallel to and symmetrically disposed in a circular formation about the longitudinal axis of the tumbler cylinder. The lock body has a matching number of cylindrical recesses 35(A thru E), which are best shown in FIG. 12, of the same diameter as those in the tumbler cylinder. On the flat face 27 of the lock body is a press-fit pin 36 which is designed to abut the edges 37 and 38 created in the machined recess 39 in the flat distal surface 26 of the tumbler cylinder, such that the limits of the tumbler cylinder rotation with respect to the lock body is precisely governed at two positions. At the first of these limit positions, each of the cylindrical recesses 34 in the tumbler cylinder individually align with each of those 35 in the lock body.

The tumbler cylinder further includes a center recess 40 created by a hole drilled from the proximal end a partial depth into and coaxial with the tumbler cylinder. The diameter of this recess is such that it breaks into the five cylindrical recesses 34(A thru E) and create a window 41 connecting between the center recess 40 and each of the cylindrical recesses 34(A thru E). The widths of thus formed windows are slightly greater than those of the blade parts 17(A thru E) to allow the key portion 15 to be fully inserted into the tumbler cylinder and for the individual blade parts to enter the individual cylindrical recesses 34(A thru E) to cooperate with the corresponding tumbler pins.

On the proximal end of the tumbler cylinder behind a radial-inwardly stepped rim is a face plate 42 which is mechanically affixed thereon and incorporates a concave surface 22 provided on its front face 21 to help guide the key into coaxial alignment with the lock assembly as earlier described and a star-shaped keyway 43 thru the entire thickness of the face plate. The keyway opening closely approximates the cross sectional shape of the key portion 15 of the key member 11 and while allowing the individual blade parts of the key portion to enter the cylindrical recesses 34 within the tumbler cylinder, it confines the tumbler pins to within the tumbler cylinder when the key is removed.

Figure 10:
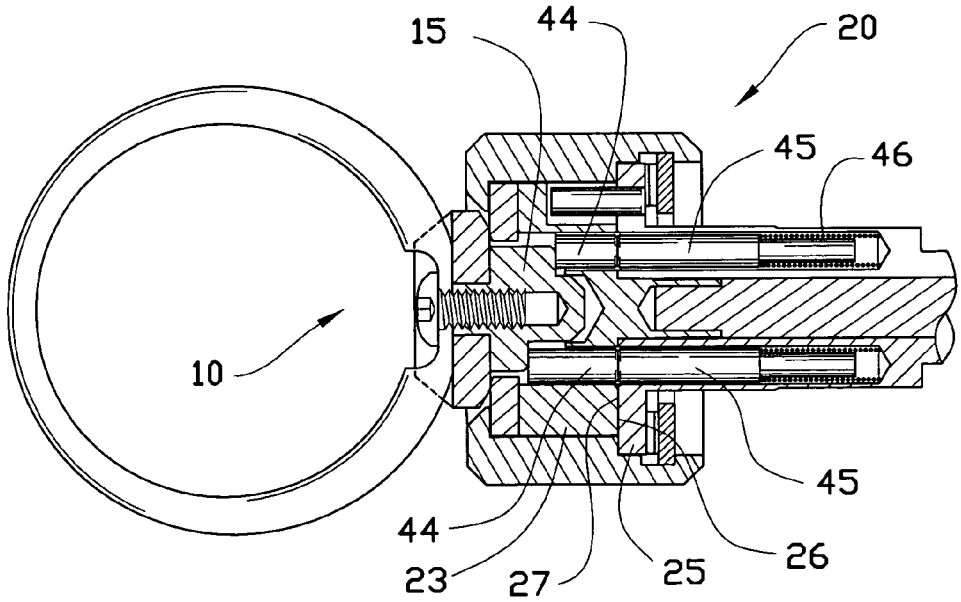
FIG. 10 is an enlarged partial cross section of the lock assembly with the correct key inserted. For simplicity and clarity, the visible two of the five pairs of tumbler pins 44 and 45 and the associated members and features are shown aligned on the section plane shown.
Figure 8:
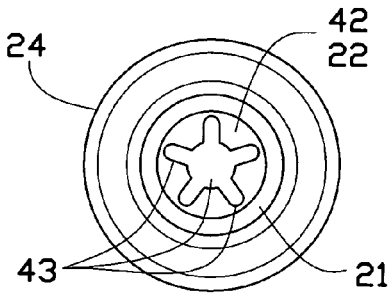
FIG. 8 shows the lock assembly viewed directly from the front.

There are a multiple pairs of tumbler pins 44 and 45 encased one pair within each of the tubular cavity formed between the cylindrical recesses 34 in the tumbler cylinder and those 35 in the lock body when these recesses are aligned at the first limit position of the tumbler cylinder as earlier described. Each pair of tumbler pins are preloaded by the spring 46 such that the proximal end of the second pin 45 abuts the distal end of the first pin 44 and both are pushed toward the proximal end of the cylindrical recesses 34 in the tumbler cylinder. The first pins are of varying lengths where their individual lengths are predetermined such that when the tumbler cylinder is at the first limit position as above described and without the correct key inserted the proximal portions of the second pins are partially received into the cylindrical recesses 34 in the tumbler cylinder while the remaining portions of the second pins stay within those recesses 35 in the lock body. This condition constitutes the "locked" configuration of the lock assembly since the second pins 45 would prevent the tumbler cylinder from being rotated with respect to the lock body. The individual lengths of the first pins are also predetermined such that when the correct key is inserted into the tumbler cylinder, each of the blade parts 17(A thru E) of the key portion 15 displaces the corresponding pair of tumbler pins by a precise amount necessary for the abutting ends of the pairs of the pins 44 and 45 to align on the same plane where the flat distal surface 26 of the tumbler cylinder abuts the flat face 27 of the lock body. This condition constitutes the "unlocked" configuration of the lock assembly as all of the pins are now confined to entirely within either the cylindrical recesses 34 in the tumbler cylinder or those 35 in the lock body, such that none of the pins would obstruct the tumbler cylinder rotation. Such unlocked configuration of the lock assembly is illustrated in FIG. 10. In the preferred embodiment there are five pairs of tumbler pins arranged in a circular formation on a equally spaced pattern of five. This is an improvement over the prior art Patent application of Ha wherein the number of pairs of tumbler pins is four, as limited by the particular means of construction for the lock assembly therein.

The lock subassembly also incorporates a torsional spring 47 connected at one end to the lock body at hole 48 and the opposite end supported by the pin 49, wherein the pin is inserted in the hole 50 of the shaft 32. The spring is preloaded to create a torque to bias the tumbler cylinder toward the locked position at all times, such that without the user intervention and/or with the key removed the lock assembly is always returned to the locked configuration.

On the outer diameter 52 of the lock body 25 is a plurality of flats 51, best shown in the cross section view of FIG. 12, prepared thereon equally spaced and physically configured such that when the lock body is inserted into the bore 54 in the barrel 53 of a firearm the flats allow the lock body to clear the ridges 55 formed between the rifling grooves 56 of the bore and fit snuggly within the bore as shown in FIG. 12. This keeps the lock body from rotating while the key is turned, and thus, further improves the speed and reliability at which the user may operate the key to unlock the lock assembly. Additionally, an index marker 57 is provided on only one of the plurality of flats to assist the user during the installation of the gun-lock device into the bore of the handgun to consistently orient the lock assembly in the same one of a several positions with respect to the bore as permitted by the rifling grooves within the bore. Most modern handguns utilize either a six or a five groove pattern, therefore the lock may be installed in a one of six or one of five possible orientations as selected by the user. The key member also has a matching index marker 58 provided to help correctly orient the key with respect to the lock assembly. The index marker 57 on the lock body would not be visible when the gun-lock device is installed in the gun. This should allow only the user to know how the key should be oriented with respect to the lock assembly in order to correctly insert the key and unlock the lock at first try. This should serve as an added safety feature, as in the event that unauthorized person intercepts the key and the locked firearm, it would likely cause a delay in his unlocking attempt as he chances one of the five key insertion possibilities, and therefore affords the user with a brief, but extremely valuable time to react.

In addition to the unique and advanced functional design features outlined above, the preferred embodiment is designed and manufactured with various provisions aimed at making the present invention tamper-resistant. First, the outer sleeve 24 and the face plate 42 comprise the only portions of the lock device which would be exposed outside of the gun barrel, when configured with the gun-lock device of prior art Patent application of Ha and inserted into the gun barrel. These two parts may be manufactured of hardened steel or a case-hardened steel, to make these extremely difficult to be cut or drilled using an ordinary metal hacksaw, drill, or any tool common to a thief. Further, the outer sleeve 24 is fastened in position using a retaining ring 60 in an internal groove, and thus, although prevented from being separated from the lock assembly, it is allowed to freely rotate about the longitudinal axis of and with respect to the lock body 25. This would prevent twisting of the outer sleeve 24 during an unauthorized removal attempt by a thief from ever inflicting a dangerous level of torsional stress on the lock assembly and thus help prevent the lock from failure.

The present invention thus provides an improved key and axial-pin disk-tumbler type lock device which may be configured in combination with a gun-lock device of the prior art Patent application of Ha. Based upon the foregoing, one of ordinary skill in the art can readily practice the invention. Although an exemplary embodiment have been shown and described it is believed that one of ordinary skill in the art may make change, modifications, and substitutions without necessarily departing from the spirit and scope of the invention.

I claim:

1. An axial-pin disk-tumbler lock device in combination with a key comprising:

a lock body having a first end, a second end, a bore thru the entire length and coaxial with the longitudinal axis of the lock body, a flat face at said first end perpendicular to the longitudinal axis of the lock body, and a plurality of at least two recesses disposed in a circular formation about the longitudinal axis of the lock body extending from said flat face a finite depth toward said second end with the longitudinal axes thereof parallel to that of the lock body;

a tumbler cylinder adapted to be coaxially rotatable about the longitudinal axis of and with respect to said lock body a partial turn while the correct key is inserted and having a flat distal surface so arranged to abut said flat face of the lock body, a front face on the end opposite that of the flat distal surface, and a plurality of at least two recesses disposed in a circular formation about the longitudinal axis of the tumbler cylinder extending from said flat distal surface a finite depth toward said front face with their longitudinal axes parallel to that of the tumbler cylinder, and the tumbler cylinder defining a first position wherein each of said plurality of recesses in the tumbler cylinder are individually in axial alignment with each of said plurality of recesses in the lock body;

a plurality of at least two pairs of cylindrical members each consisting of a first member and a second member, wherein the first members are of varying lengths and each of the first members are axially disposed within each of said plurality of recesses in the tumbler cylinder and each of the second members are axially disposed within each of said plurality of recesses in the lock body;

a spring behind each of said second members within each of the plurality of recesses in the lock body;

a keyway within said tumbler cylinder extending from said front face a finite depth toward said flat distal surface, wherein the cross sectional shape of the keyway comprising a center hole coaxially within the tumbler cylinder and a plurality of radial-outwardly projecting slots individually connecting between said center hole with each of said plurality of recesses in the tumbler cylinder and physically so proportioned and arranged that it allows the key access into said plurality of recesses in the tumbler cylinder to cooperate with said plurality of pairs of cylindrical members while confining said cylindrical members to within their respective recesses while the key is removed; and an improved key member having a body portion with a substantially flat face so arranged to abut said front face of the tumbler cylinder when the key is fully inserted into said keyway and a key portion projecting outward from and perpendicular to said flat face, wherein the key portion having a cross section shape defining a center pillar part and a plurality of at least two blade parts radial-outwardly projecting therefrom and said blade parts are individually trimmed to predetermined heights above said flat face and are inserted through said slots in said keyway into said plurality of recesses in the tumbler cylinder to cooperate with said plurality of cylindrical members.

2. A lock device in combination with a key as recited in claim 1, wherein:

said pairs of cylindrical members and said plurality of recesses in the tumbler cylinder are arranged in such physical proportions that while the tumbler cylinder is at said first position, each of said pairs of cylindrical members are preloaded by each of said springs toward said front face of the tumbler cylinder and result in each of said second members of the pairs of cylindrical members being partially received into each of the plurality of recesses in the tumbler cylinder while the remaining portions of the second members remain within the plurality of recesses in the lock body, thus, the second members obstruct the tumbler cylinder rotation; and said first members of said varying lengths of the pairs of cylindrical members are individually so assigned to each of said plurality of recesses in the tumbler cylinder, such that when a correct key is correctly inserted through said keyway into the tumbler cylinder each of the pairs of the cylindrical members are displaced toward said second end of the lock body by a precise amount such that the entire portion of each of said first members remain within each of the plurality of recesses in the tumbler cylinder and the entire portion of each of said second members remain within each of the plurality of recesses in the lock body, thus, none of the first members nor second members obstruct the tumbler cylinder rotation.

3. A lock device in combination with a key as recited in claim 1, wherein:

said front face of said tumbler cylinder having a concave feature thereon coaxial with the longitudinal axis of said keyway and said center pillar part of said key portion of said key member having a convex feature at the free-end thereof; and said concave and said convex features provide a means for the key member to be quickly guided into axial alignment with the keyway while the key is being inserted into the keyway.

4. A lock device in combination with a key as recited in claim 1 further including an outer sleeve with a hollow interior for partially shrouding said tumbler cylinder and said lock body, wherein outer sleeve having at its proximal end portion a radial-inwardly stepped rim physically proportioned to contain said tumbler cylinder to within said hollow interior while allowing said flat face of said body portion of said key member access to fully abut said front face of the tumbler cylinder and at its distal end portion an internal groove so arranged for the outer sleeve to be mechanically secured to the lock body using a retaining ring fastener such that the outer sleeve is allowed to be rotated coaxially about the longitudinal axis of the lock body while prevented from being axially moved with respect to or disassembled from the lock body.

5. A lock device in combination with a key as recited in claim 1, wherein said plurality of pairs of cylindrical members consist of five pairs, said plurality of recesses in said tumbler cylinder are five recesses, said plurality of recesses in said lock body are five recesses, said varying lengths of said first members are four lengths in equally divisible increments, said plurality of radially projecting slots of said keyway are five slots, and said plurality of blade parts of said key portion are five blade parts.

6. A lock device in combination with a key as recited in claim 1, wherein said body portion and said key portion of said key member are integrated into a one-piece member fabricated by machining from a one-piece billet material.

7. A lock device in combination with a key as recited in claim 1, wherein said body portion and said key portion of said key member are integrated into a one-piece member fabricated by a metal casting process.

8. A lock device in combination with a key as recited in claim 1, wherein said body portion and said key portion of said key member are integrated into a one-piece member fabricated by an injection molding process using a thermoplastic material.

9. A lock device in combination with a key as recited in claim 1, wherein said key member is arranged to allow it to be mounted onto various substrate bodies for ease of handling, wherein various substrate bodies including a ring member which may be worn on a finger of the user.

10. A lock device in combination with a key as recited in claim 9, wherein said key member and said ring member are integrated into a one-piece unit fabricated by machining from a one-piece billet material.

11. A lock device in combination with a key as recited in claim 9, wherein said key member and said ring member are integrated into a one-piece unit fabricated by a metal casting process.

12. A lock device in combination with a key as recited in claim 9, wherein said key member and said ring member are integrated into a one-piece unit fabricated by an injection molding process using a thermo-plastic material.

13. An axial-pin disk-tumbler lock device in combination with a key comprising:

a lock body having a first end, a second end, a bore thru the entire length and coaxial with the longitudinal axis of the lock body, a flat face at said first end perpendicular to the longitudinal axis of the lock body, and a plurality of at least two recesses disposed in a circular formation about the longitudinal axis of the lock body extending from said flat face a finite depth toward said second end with the longitudinal axes thereof parallel to that of the lock body;

a tumbler cylinder adapted to be coaxially rotatable about the longitudinal axis of and with respect to said lock body a partial turn while the correct key is inserted and having a flat distal surface so arranged to abut said flat face of the lock body, a flat proximal surface on the end opposite that of the flat distal surface, a plurality of at least two recesses disposed in a circular formation about the longitudinal axis of the tumbler cylinder and extending through the entire length of and with their longitudinal axes parallel to that of the tumbler cylinder, and a center recess of substantially circular cross section extending from said flat proximal surface a finite depth toward said flat distal surface and physically proportioned such that its outer periphery breaks into said plurality of recesses in the tumbler cylinder forming rectangular windows each connecting between the center recess and each of said plurality of recesses, and the tumbler cylinder defining a first position wherein each of said plurality of recesses in the tumbler cylinder are individually in axial alignment with each of said plurality of recesses in the lock body;

a plurality of at least two pairs of cylindrical members each consisting of a first member and a second member, wherein the first members are of varying lengths and each of the first members are axially disposed within each of said plurality of recesses in the tumbler cylinder and each of the second members are axially disposed within each of said plurality of recesses in the lock body;

a spring behind each of said second members within each of the plurality of recesses in the lock body;

a substantially thin face plate having a front face, a rear surface, and an outer diameter similar to that of the tumbler cylinder, wherein the rear surface is made to abut said flat proximal surface of the tumbler cylinder and said face plate mechanically fastened to the tumbler cylinder for operation in unison therewith;

a keyway through the entire thickness and coaxial with the longitudinal axis of the face plate wherein the cross sectional shape of the keyway comprising a center hole coaxially within the face plate and a plurality of radial-outwardly projecting slots physically so proportioned and arranged that it allows the key member to be inserted through the keyway to access said plurality of recesses in the tumbler cylinder to cooperate with said plurality of pairs of cylindrical members while confining said cylindrical members to within their respective recesses while the key is removed; and an improved key member having a body portion with a substantially flat face so arranged to abut said front face of said face plate when the key is fully inserted into said keyway and a key portion projecting outward from and perpendicular to said flat face, wherein the key portion having a cross section shape defining a center pillar part and a plurality of at least two blade parts radial-outwardly projecting therefrom and said blade parts are individually trimmed to predetermined heights above said flat face and are inserted through said slots in said keyway into said plurality of recesses in the tumbler cylinder to cooperate with said plurality of cylindrical members.

14. A lock device in combination with a key as recited in claim 13, wherein:

said pairs of cylindrical members and said plurality of recesses in the tumbler cylinder are arranged in such physical proportions that while the tumbler cylinder is at said first position, each of said pairs of cylindrical members are preloaded by each of said springs toward said flat proximal surface of the tumbler cylinder and result in each of said second members of the pairs of cylindrical members being partially received into each of the plurality of recesses in the tumbler cylinder while the remaining portions of the second members remain within the plurality of recesses in the lock body, thus, the second members obstruct the tumbler cylinder rotation; and said first members of said varying lengths of the pairs of cylindrical members are individually so assigned to each of said plurality of recesses in the tumbler cylinder, such that when a correct key is correctly inserted through said keyway into the tumbler cylinder each of the pairs of the cylindrical members are displaced toward said second end of the lock body by a precise amount such that the entire portion of each of said first members remain within each of the plurality of recesses in the tumbler cylinder and the entire portion of each of said second members remain within each of the plurality of recesses in the lock body, thus, none of the first members nor second members obstruct the tumbler cylinder rotation.

15. A lock device in combination with a key as recited in claim 13, wherein:

said front face of said face plate having a concave feature thereon coaxial with the longitudinal axis of said keyway and said center pillar part of said key portion of said key member having a convex feature at the free-end thereof; and said concave and said convex features provide a means for the key member to be quickly guided into axial alignment with the keyway while the key is being inserted into the keyway.

16. A lock device in combination with a key as recited in claim 13 further including an outer sleeve with a hollow interior for partially shrouding said tumbler cylinder, said face plate, and said lock body, wherein outer sleeve having at its proximal end portion a radial-inwardly stepped rim physically proportioned to contain said tumbler cylinder to within said hollow interior while allowing said flat face of said body portion of said key member access to fully abut said front face of said face plate and at its distal end portion an internal groove so arranged for the outer sleeve to be mechanically secured to the lock body using a retaining ring fastener such that the outer sleeve is allowed to be rotated coaxially about the longitudinal axis of the lock body while prevented from being axially moved with respect to or disassembled from the lock body.

17. A lock device in combination with a key as recited in claim 13, wherein said plurality of pairs of cylindrical members consist of five pairs, said plurality of recesses in said tumbler cylinder are five recesses, said plurality of recesses in said lock body are five recesses, said varying lengths of said first members are four lengths in equally divisible increments, said plurality of radially projecting slots of said keyway are five slots, and said plurality of blade parts of said key portion are five blade parts.

18. A lock device in combination with a key as recited in claim 13, wherein said body portion and the key portion of said key member are integrated into a one-piece member fabricated by machining from a one-piece billet material.

19. A lock device in combination with a key as recited in claim 13, wherein said body portion and the key portion of said key member are integrated into a one-piece member fabricated by a metal casting process.

20. A lock device in combination with a key as recited in claim 13, wherein said body portion and the key portion of said key member are integrated into a one-piece member fabricated by an injection molding process using a thermo-plastic material.

21. A lock device in combination with a key as recited in claim 13, wherein said key member is arranged to allow it to be mounted onto various substrate bodies for ease of handling, wherein various substrate bodies including a ring member which may be worn on a finger of the user.

22. A lock device in combination with a key as recited in claim 21, wherein said key member and said ring member are integrated into a one-piece unit fabricated by machining from a one-piece billet material.

23. A lock device in combination with a key as recited in claim 21, wherein said key member and said ring member are integrated into a one-piece unit fabricated by a metal casting process.

24. A lock device in combination with a key as recited in claim 21, wherein said key member and said ring member are integrated into one-piece unit fabricated by an injection molding process using a thermo-plastic material.

* * * * *